US006638456B2

(12) United States Patent
Klein et al.

(10) Patent No.: US 6,638,456 B2
(45) Date of Patent: Oct. 28, 2003

(54) PROCESS OF PRODUCING SYNTHETIC THREADS FROM A POLYESTER-BASED POLYMER MIXTURE

(75) Inventors: Alexander Klein, Ingelheim (DE); Dietmar Wandel, Hanau (DE)

(73) Assignee: Zimmer A.G., Frankfurt am Main (DE)

( * ) Notice: Subject to any disclaimer, the term of this patent is extended or adjusted under 35 U.S.C. 154(b) by 307 days.

(21) Appl. No.: 09/861,386

(22) Filed: May 18, 2001

(65) Prior Publication Data

US 2002/0014718 A1 Feb. 7, 2002

(30) Foreign Application Priority Data

May 25, 2000 (DE) ..... 100 22 889

(51) Int. Cl.[7] ..... D01D 1/06; D01D 5/08; D01F 6/62; D02G 3/02

(52) U.S. Cl. ..... 264/103; 264/176.1

(58) Field of Search ..... 264/103, 176.1

(56) References Cited

FOREIGN PATENT DOCUMENTS

| | | | | |
|---|---|---|---|---|
| DE | 2009617 A | * | 10/1970 | |
| DE | 4039857 A1 | | 4/1992 | |
| JP | 61174408 A | * | 8/1986 | ..... 264/176.1 |
| WO | 9907927 A1 | | 2/1999 | |
| WO | 0111122 A1 | | 2/2001 | |

OTHER PUBLICATIONS

Abstract of Japan 56015404 (Feb. 14, 1981).

* cited by examiner

*Primary Examiner*—Leo B. Tentoni
(74) *Attorney, Agent, or Firm*—McDonnell Boehnen Hulbert & Berghoff

(57) ABSTRACT

A first stream of a polyester melt is divided into a second and a third polyester stream, the flow rate of the first stream being 100 to 2000 kg/h and the flow rate of the second polyester stream being 5 to 300 kg/h. 0.2 to 100 kg/h of a molten additive polymer is metered to the second polyester stream, and the additive polymer together with the second polyester stream is passed through a first mixing line. There is obtained a first polymer mixture whose content of additive polymer is 3 to 50 wt-%. The first polymer mixture is introduced into the third polyester stream, the first mixture together with the third polyester stream being passed through a second mixing line and forming a second polymer mixture. The second polymer mixture is extruded to obtain filaments, the filaments are cooled and combined to threads, the threads are unwound with a speed of at least 1000 m/min. The threads are processed to obtain either continuous threads or staple fibers.

7 Claims, 1 Drawing Sheet

PROCESS OF PRODUCING SYNTHETIC THREADS FROM A POLYESTER-BASED POLYMER MIXTURE

BACKGROUND OF THE INVENTION

1. Field of the Invention

This invention relates to a process of producing synthetic threads from a polyester-based polymer mixture. The threads produced are suitable for use as continuous threads or can be processed to obtain staple fibers.

2. Summary of the Related Art

Spinning modified polymers is known and described, for example, in EP-A-0,860,524. A mixing means for mixing a polymer melt with a low-viscosity, liquid or gaseous additive is known from EP-A-0,766,996. Processing polymer mixtures to obtain filaments is described in WO 99/07927.

Normally, the design of mixing systems is not critical. However, polymer mixtures for the purpose of increasing elongation when spinning threads at high speed require certain measures with respect to the mixing efficiency in order to obtain a homogeneous and finely dispersed mixture and at the same time provide for thermally stable processing.

When producing polymer mixtures in large extruder spinning plants or direct spinning plants in which the matrix polymer melt is forced into at least one spinning line and exposed to high dwell times, one must substantially prevent mixing faults, thread faults and processing faults to ensure a high quality end product In particular, when certain additives are used, the high thermal load in such plants leads to a breakdown of the polymer, which results in a undesirably high level of low-molecular breakdown products as well as visible discolorations in the end product. WO 99/57348 discloses polymer mixtures whose additives lead to an unacceptable yellowing of the textile thread. Even when adding a phosphorus stabilizer, although perfect spools were obtained at first in a pilot plant, the yarn appeared yellowish when produced in a production plant with a distinctly higher melt dwell time.

SUMMARY OF THE INVENTION

The present invention comprises an improved method of producing polyester threads. The threads produced according to the invention can be processed to obtain staple fibers. Flat or bulky textile threads can be produced from flat threads. When textile threads are desired, unwinding speeds between 2500 and 3600 m/min can been employed, depending on the titer to be produced. Such POY threads have elongations at break of 85 to 180%, which is advantageous for further processing in a stretching process or stretch texturizing process. While it is known from the prior art that increased unwinding speeds result in reduced elongation at break of the thread and the minimum elongation at break necessary for processing cannot be guaranteed. Only by modifying the polymer and, in particular, using specific polymer mixtures according to the invention can a satisfactory elongation at break be achieved at high unwinding speeds. We discovered, however, that the amount of additive to be added to obtain low elongations at break must be increased considerably with increased unwinding speed or under spinning conditions.

The present invention comprises a method of increasing the elongation at break for polyester-based spun threads in high-capacity spinning plants in an economically optimized way. At the same time, the elongation at break values required for further processing in a stretching process or stretch texturizing process are adjustable at high spinning speeds. Furthermore, improved spooling behavior and reduction of faults in the spooled thread is obtained, so that, for example, high uniformity is ensured when dyeing the textile thread upon further processing.

The method comprises splitting a first polyester melt stream into a second and third stream, mixing an additive polymer into the second stream, adding the mixture to the third stream, and extruding, wherein the ratio of viscosity of the additive polymer and the second stream is judiciously selected. The aforementioned benefits are achieved as a result of the method under the conditions described below.

DETAILED DESCRIPTION OF THE INVENTION

Figure 1:
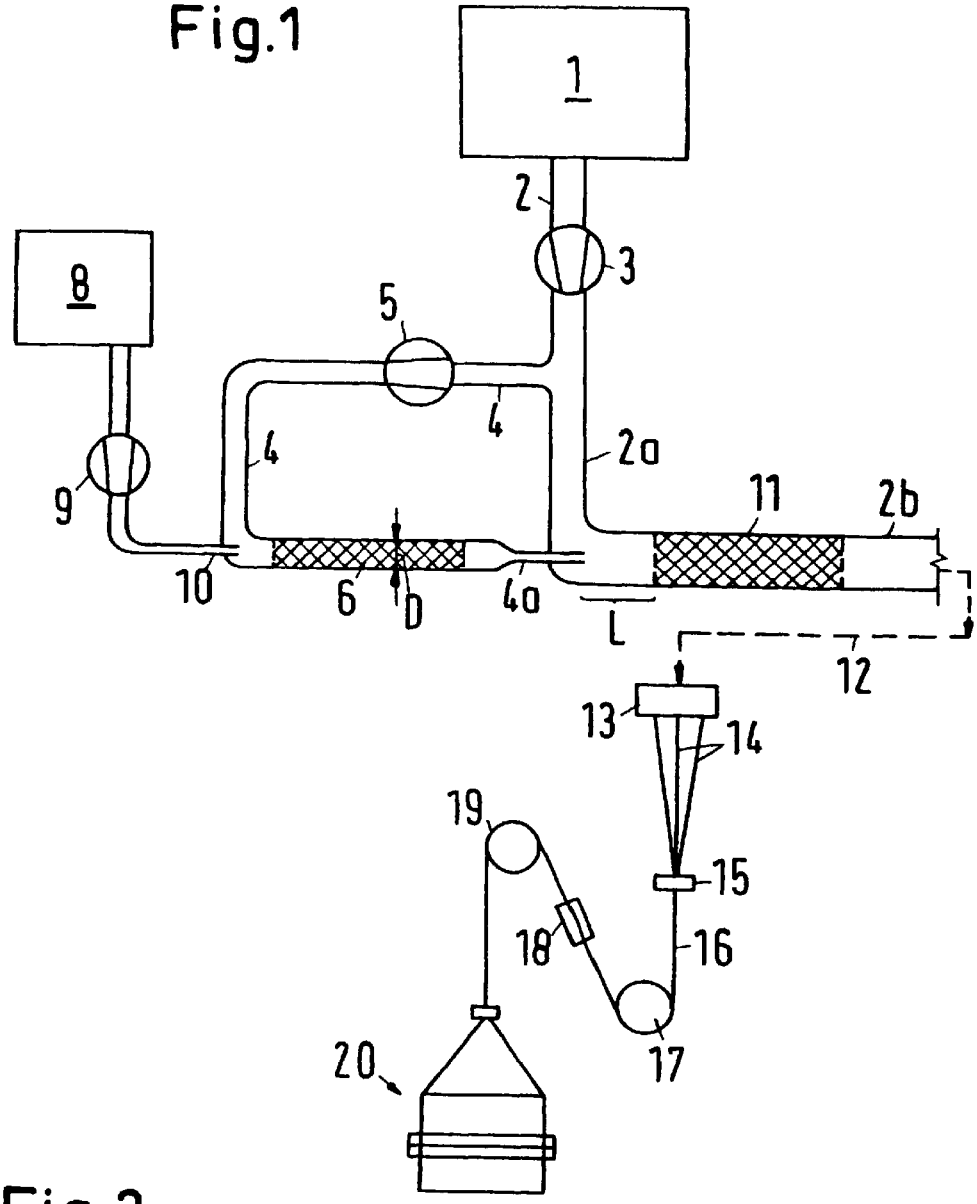
FIG. 1 shows a flow diagram of the process according to the invention.

According to the method of the invention:

a) a first stream of a polyester melt is divided into a second and a third polyester stream, the flow rate of the first stream being 100 to 2000 kg/h and the flow rate of the second polyester stream being 5 to 300 kg/h, b) 0.2 to 100 kg/h of a molten additive polymer are metered to the second polyester stream, and the additive polymer together with the polyester of the second stream is passed through a first mixing line having flow obstacles, thereby forming a first polymer mixture whose content of additive polymer is 3 to 50 wt-%, preferably between 5 and 30 wt-%, wherein the ratio of the melt viscosity of the additive polymer and of the polyester of the first stream is 0.8:1 to 10:1, c) the first polymer mixture is passed through a line portion and is introduced into the third polyester stream, and the first mixture together with the third polyester stream is passed through a second mixing line having flow obstacles, thereby forming a second polymer mixture, and d) the second polymer mixture is extruded to obtain filaments, which are cooled and combined to form threads, and the threads unwound with a speed of at least 1000 m/min.

Preferably, the additive polymer is amorphous and insoluble in the polyester matrix. The additive polymer usually has a glass transition temperature of 90 to 200° C. The glass transition temperature can be determined in a known manner by differential scanning calorimetry (cf. WO 99/07927). This amorphous polymer is suitable for thermoplastic processing. The additive polymer is kept in the molten state for a dwell time of 0.1 to 5 minutes before it contacts the second polyester stream upon leaving the extruder. During this dwell time, a metering pump is used to supply the additive polymer from an extruder to the point of introduction into the second polymer stream. Furthermore, upon leaving the extruder the additive polymer is kept in the molten state for a dwell time of 0.2 to 7 minutes before it contacts the third polyester stream. The dwell time of the second polymer mixture before entry into the package of spinning nozzles is less than 15 min. The dwell times can be adjusted in a known manner by choice of product line dimensions and melt flow rate and determined as mean dwell time.

The additive polymer is chosen such that the ratio of the melt viscosities of the additive polymer and of the polyester of the first stream is 0.8:1 to 10:1 and preferably 1.5:1 to 8:1. The melt viscosity can be measured in a known manner by means of an oscillation rheometer at an oscillation frequency of 2.4 Hz and a temperature equal to the melting temperature of the polyester plus 34° C. For polyethylene terephthalate, the temperature for measuring the melt viscosity is about 290° C. Details are found in WO 99/07927. The melt viscosity of the additive polymer preferably is higher than that of polyester. We have found that the choice of specific viscosity range for the additive polymer and the choice of viscosity ratio contributes to optimization of the properties of the thread produced. With an optimized viscosity ratio, the amount of additive polymer can be minimized, thereby making the process more economical. The polymer mixture to be spun usually contains 0.05 to 5.0 wt-% additive polymer.

By choosing the favorable viscosity ratios in connection with the division of the melt streams according to the invention, one obtains a narrow distribution of additive polymer particle sizes in the polyester matrix with the desired fibril structure of the additive polymer in the thread. The higher glass transition temperature of the additive polymer relative to the polyester ensures a rapid stabilization of its fibril structure in the filament. The maximum particle size of the additive polymer directly upon leaving the spinning nozzle is about 1000 mn, whereas the mean particle size is 400 nm or less. Favorable fibril structure is achieved upon drafting the thread, wherein the threads contain at least 6wt-% of the additive polymer in the form of fibrils with lengths in the range from 0.5 to 20 $\mu$m and diameters in the range from 0.01 to 0.5 $\mu$m. When using a draft of 50 to 200 or preferably 70 to 160, spooling becomes particularly favorable.

The additive polymer is preferably chosen from the following:

1. A copolymer comprising 60 to 98 wt-% A and 2 to 40 wt-% B, preferably 83 to 98 wt-% A and 2 to 17 wt-% B, and particularly preferably 90 to 98 wt-% A and 2 to 10 wt-% B (sum=100 wt-%), wherein
   A=acrylic acid, methacrylic acid or $CH_2$=CR—COOR', where R is —H or —$CH_3$ and R' is $C_{1-15}$ alkyl, $C_{5-12}$ cycloalkyl, or $C_{6-14}$ aryl,
   B=styrene or $C_{1-3}$-alkyl-substituted styrene,
2. A copolymer comprising 15 to 95 wt-% C and 2 to 80 wt-% D, preferably of 50 to 90 wt-% C and 10 to 50 wt-% D, and particularly preferably of 70 to 85 wt-% C and 15 to 30 wt-% D, the sum of C and D together making 100 wt-%, wherein
   C=styrene or $C_{1-3}$-alkyl-substituted styrene
   D=one or more monomers of formula I, II or III

I

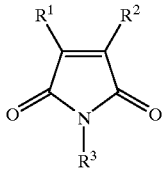

-continued

II

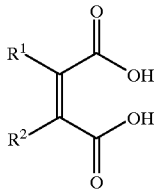

III

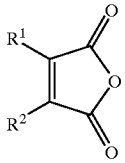

where $R^1$, $R^2$ and $R^3$ are each independently —H, $C_{1-15}$ alkyl, $C_{6-14}$ aryl, or $C_{5-12}$ cycloalkyl, 3. A copolymer comprising 30 to 99 wt-% E, 0 to 50 wt-% F, >0 to 50 wt-% G and 0 to 50 wt-% H, preferably of 45 to 97 wt-% E, 0 to 30 wt-% F, 3 to 40 wt-% G and 0 to 30 wt-% H, and particularly preferably of 60 to 94 wt-% E, 0 to 20 wt-% F, 6 to 30 wt-% G and 0 to 20 wt-% H, the sum of E, F, G and H together making 100 wt-%, wherein
   E=acrylic acid, methacrylic acid or $CH_2$=CR—COOR', where R is —H or —$CH_3$, and R' is $C_{1-15}$ akyl, $C_{5-12}$ cycloalkyl, or $C_{6-14}$ aryl,
   F=styrene or $C_{1-3}$-alkyl-substituted styrene,
   G=one or more monomers of formula I, II or III

I

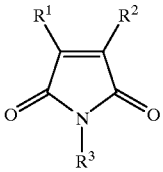

II

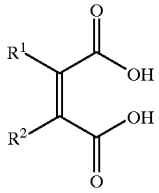

III

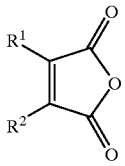

where $R^1$, $R^2$ and $R^3$ are each independently —H, $C_{1-15}$ alkyl, $C_{5-12}$ cycloalkyl, or $C_{6-14}$ aryl, H=one or more ethylenically unsaturated monomers copolymerizable with E, F, and/or G, selected from the group consisting of-methylstyrene, vinyl acetate, acrylic esters and methacrylic estersthat are different from E, vinyl chloride, vinylidene chloride, halogen-substituted styrenes, vinyl ethers, isopropenyl ethers and dienes.

4. A polymer from the following monomer unit:

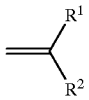

where $R^1$ and $R^2$ are substituents consisting of the optional atoms C, H, O, S, P and halogen atoms, and the sum of the molecular weight of $R^1$ and $R^2$ is at least 40 (e.g., polystyrene or polymethyl methacrylate).

Details of the production of these substances are described in WO 99/07927.

Embodiments of the process are explained with reference to the drawings.

As shown in FIG. 1, a polyester melt as base polymer comes from a reservoir (1), which may be an extruder or a polycondensation reactor. The polyester stream (referred to as the "first stream"), which should be at temperatures in the range of 230–330° C. (distinctly above its melting point) first flows through line (2) under the pressure of the extruder or under the influence of the first pump (3) to a branching point from which line (4) branches off. Optionally, the melt flows through one or more filters, booster pumps and/ heat exchangers, in which case the branching point preferably is behind the heat exchanger, which cools the polymer stream by about 2 to 15° C. Under the influence of the second pump (5), the portion of the polyester (referred to as "second polyester stream") flows to a first mixing line (6), which is used as static mixer.

Additive polymer melt comes from an extruder (8) having an outlet temperature that is 5 to 70° C. (and preferably at least 10° C.) lower than the temperature of the first polyester stream. Preferably, the monomer content in the additive polymer leaving the extruder is not more than about 0.6 wt-%. This may be achieved, for example, by judicious selection of raw product and/or by degassing in the extruder. Under the influence of the third metering pump (9), the additive polymer is supplied to a metering point (10), where it enters the second polymer stream.

Mixing in the first mixing line (6) is effected by means of flow obstacles (e.g., mixing elements SMX, firm Sulzer). The tube in the middle of the mixing line (6) has inside diameter (D), measured with empty line. The first polymer mixture leaves the mixing line (6) and flows through a mixer-free line portion (4*a*) into the third polyester stream, which moves through line (2*a*). The first polymer mixture moves along a flow line of length (L) in contact with the third polyester stream until it reaches the flow obstacles of the second mixing line (11). It is preferable that L=2D and/or the diameter within the length L have a tapered cross-section to increase the polymer flow rate. The first mixture from line portion (4*a*) together with the third polyester stream is then passed through second mixing line (11), which likewise constitutes a static mixer. At the end of the second mixing line (11), a second polymer mixture is formed, which leaves the mixing region through line portion (2*b*) and is divided into a multiplicity of spinning points. Preferably, the length of the first mixing line (6) and the second mixing line (11) is 6 to 15 times larger than the inside diameter of the respective mixing line.

The second polymer mixture is supplied through line (12) (represented in broken lines) to a spinning point (indicated schematically). The polymer mixture is extruded through the spinning package (13), forming numerous filaments (14), which are cooled, combined and supplied with spinning oil (15). When it is desired to produce textile threads, the formed thread (16 runs over a first galette (17), then through an interlacing means (18) to a second galette (19). The unwinding speed for the thread, defined as peripheral speed of the galette (17), is at least 3500 m/min and preferably from 4000 to 9000 m/min. The thread runs to a spooling means (20), where it is spooled. The draft ratio, i.e., the ratio of the unwinding speed to the extrusion speed at the nozzle outlet, advantageously is 50 to 200, which yields POY threads, for example, with good spooling properties.

Methods for further processing the thread to obtain textile thread are known and therefore not represented in the drawing. The thread is subjected to a stretching or stretch texturizing process in which the elongation at break is reduced from 85 to 180% to about 15 to 45%. For the production of staple fibers, the threads are unwound at speeds of at least 1000 m/min over galettes and coiled in cans. Further processing can be effected in a known manner in a fiber line.

Figure 2:
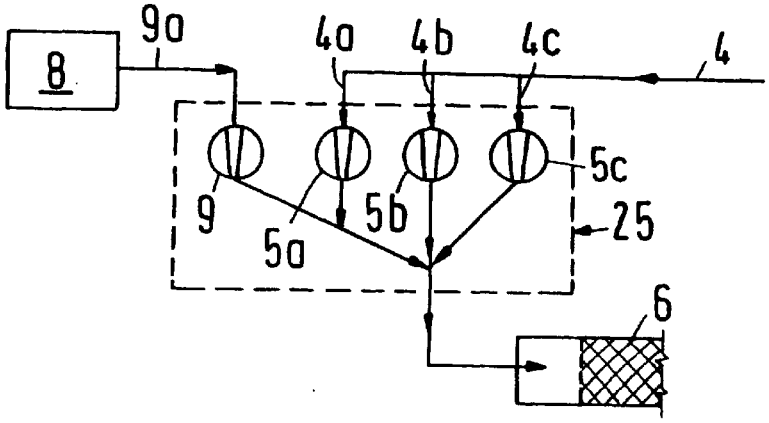
FIG. 2 shows an example of a pump unit for joining the second polyester stream with the additive polymer in a schematic representation.

As shown in FIG. 2, additive polymer is supplied through line (9*a*) and the second polyester stream is supplied through the branch lines (4*a*, 4*b*, 4*c*) to pump unit (25). In this schematic representation, the unit includes individual metering pumps (9) as well as (5*a*), (5*b*), and (5*c*).

The metering pumps may be designed as jointly driven chambers of a planet wheel pump, such as described in DE 19841376 A1, incorporated herein by reference. The unit feeds the mixture produced therein into the first mixing line (6).

EXAMPLE 1

As shown in FIG. 1, the procedure according to the invention was exemplified as follows:

A melt of polyethylene terephthalate with an intrinsic viscosity of 0.64 dl/g(corresponding to a melt viscosity at 290° C. of 250 Pas and a temperature of 282° C.) was discharged from a reactor and moved through the melt line by means of a booster pump with a pressure of 205 bar. The melt flowed through a 20 m filter and a heat exchanger that cooled the temperature of the melt from 292° C. to 288° C. This first stream (which had a flow rate of 423.0 kg/h) was divided and branched into the second stream with a flow rate of 21.18 kg/h, corresponding to 5.0 wt-% of the first stream, and into the third stream with a flow rate of 401.82 kg/h.

A copolymeric additive of the 1st group of substances (above), containing 91 wt-% methyl methacrylate and 9 wt-% styrene with a melt viscosity measured at 290° C. of 1100 Pas was used. The additive (predried to a residual moisture of<0.1 wt-%) was melted in an extruder with degassing, supplied to a metering pump (9) at a melt temperature of 255° C., and added to the second stream in line (4) with a flow rate of 2.115 kg/h. The subsequent mixing (mixing line 6) was effected in a first mixer (type SMX of the firm Sulzer/CH) with an inside diameter of 26.5 mm and a length of 160 mm. The dwell time of the additive melt from the outlet of the extruder until contact with the second partial stream was 2.9 min. The first mixture had a content of additive polymer of 9 wt-%.

The first mixture was introduced into the third polyester stream and after a flow length L=110 mm supplied to a second mixer (11) with an inside diameter of 65 mm and a length of 910 mm, homogenized therein, and dispersed.

The dwell time of the additive polymer from the outlet of the extruder until contact with the third polyester stream was 3.5 min.

The second polymer mixture was distributed via product lines over 20 spinning positions, each position including 6 packages of spinning nozzles. The dwell time of the second polymer mixture until entry in the spinning package was 5 min. Each spinning package contained a round nozzle with 34 holes of diameter 0.25 mm and length 2 times the diameter. Furthermore, the spinning package contained a spinning filter package above the nozzle plate comprising a steel sand package having height of 30 mm and grain size of 0.35 to 0.50 mm as well as a microfine gauze having a pore diameter of 40 $\mu$m and a steel web filter having a pore diameter of 20 $\mu$m. The cross-sectional area of the spinning filter package was 40 $cm^2$. The dwell time of the melt in the filter package was about 1.8 min. During passage of the melt mixture, a nozzle pressure of 145 bar was observed; this is slightly lower than in the case of a PET melt without additive. The heating of the spinning package was adjusted to 288° C.

Molten filaments extruded from the nozzle holes were cooled by air blown transversely to the course of the thread with a speed of 0.5 m/sec and a temperature of 19° C. The filaments were bundled in an oiling stone (15) at a distance of 1400 mm from the nozzle plate and coated with spinning oil.

A pair of galettes enlaced in an S-shaped manner unwound the thread with a speed of 4320 m/min, adjusted to a draft ratio of 149. An interlacing nozzle (18) was installed between the galettes and was closed in the case of normal course of the thread. With an air pressure of 4.0 bar, the interlacing nozzle impressed a number of interlacing knots (12 knots/m) on the thread. The thread tension at the inlet of the interlacing nozzle was adjusted to 0.15 g/den.

Six threads from each spinning position were spooled to form spool packages in a spooler, where a speed of 4290 m/min was chosen such that the thread tension before spooling was 0.10 g/den.

Pre-oriented threads (POY), characterized by a titer of 128 den, a tear strength of 2.5 g/den, and an elongation at break of 117% were obtained. The POY spools were stretch-texturized in a Barmag texturizing machine, type FK6, with a speed of 900 m/min. A draft ratio of 1.70 was chosen. The first heater had a temperature of 210° C., the second heater a temperature of 170° C.

The texturized yam has a titer of 76 den, a tear strength of 4.6 g/den, and an elongation at break of 22% and accepts dye uniformly. The process in accordance with the invention is also characterized in particular by a small number of broken threads both during spinning and during texturizing.

EXAMPLE 2

The pump unit explained in FIG. 2 was employed in this example. Polyethylene terephthalate chips with a water content of less than 35 ppm and with an intrinsic viscosity of 0.64 dl/g were melted in an extruder and discharged at a temperature of 290° C. with a pressure of 180 bar, conveyed as melt stream of 302.4 kg/h through the melt line, and subjected to a filtration with a filtering candle of 20 $\mu$m.

This filtered first polyester stream with a flow rate of 302.4 kg/h was divided and branched into the second polyester stream with a flow rate of 13.98 kg/h (corresponding to 4.62 wt-% of the first stream) and the third stream with a flow rate of 288.42 kg/h.

For metering and transporting the second partial stream and the additive stream, a left-handed six-fold planet wheel pump of the firm Mahr GmbH, Göttingen, Germany was used. This is a spinning pump with 6 metering pumps, which by reversing the direction of rotation and thus the flow direction combines the identical volume flows of 6 inlet passages into one outlet passage.

The second polyester stream was supplied in equal parts to 5 of 6 inlets of the planet wheel pump.

A copolymeric additive of the third group of substances, containing 9 wt-% styrene, 89 wt-% methyl methacrylate, and 2 wt-% N-cyclohexyl maleinimide, was chosen with a melt viscosity (at 290° C.) of 1440 Pas.

The additive dried to a residual moisture of <0.1 wt-% was melted in an extruder and supplied to the remaining inlet passage of the planet wheel pump at a melt temperature of 265° C. with a flow rate of 2.33 kg/h, corresponding to 0.77 wt-% of the first polyester stream. In the outlet passage of the planet wheel pump, this additive stream was combined and premixed with the polyester stream from one of the five inlet passages fed with polyester before the polyester streams of the four remaining inlet passages were supplied to this premix in the outlet of the planet wheel pump. The dwell time of the additive melt from the extruder outlet to the outlet of the planet wheel pump was 70 sec. The subsequent processing was effected in a first static mixer (6) of the type SMXS DN 17 of Sulzer AG, Zurich, Switzerland, with an inside diameter of 17.8 mm and a length of 9 times the inside diameter; the mixture had an additive content of 16.7 wt-%.

This first mixture was introduced into the third polyester stream and after a flow length L=72 mm supplied to a second mixer (11) of the type SMX of Sulzer AG with an inside diameter of 52.5 mm and a length of 525 mm, where it was homogenized and dispersed. The dwell time of the additive melt from the extruder outlet until contact with the third polyester stream was 100 sec.

By means of the product line, this second polymer mixture was distributed over 12 spinning positions, each position including 6 spinning packages, where the dwell time of the second polymer mixture from leaving the second mixture (11) until entering the spinning package was 5 min. Each spinning package contained a round nozzle with 34 holes having a diameter of 0.25 mm and a length of 2 times the diameter. Above the nozzle plate, the spinning package included a spinning filter package comprising a steel sand package with a height of 30 mm and a grain size of 0.5 to 0.85 mm as well as a gauze with a pore diameter of 40 $\mu$m and a steel web filter with a pore diameter of 20 $\mu$m. The diameter of the spinning filter package was 85 mm. The dwell time of the melt in the filter package was about 1.5 min. The heating of the spinning package was adjusted to 290° C. The surface of the spinning nozzle was 30 mm above the boundary of the heating box. During passage of the melt mixture a nozzle pressure of 150 bar was obtained.

The molten filaments extruded from the nozzle holes were cooled by means of blow air flowing transversely to the direction of the thread with a speed of 0.55 m/sec and a temperature of 18° C. The filaments were bundled to form thread in an oiling stone (15) at a distance of 1250 mm from the nozzle plate and were coated with spinning oil.

A pair of galettes enlaced in an S-shaped manner unwound the thread with a speed of 5000 m/min, where the draft ratio was adjusted to 141.

Between the galettes, an interlacing nozzle (18) (which was closed in the case of a normal course of the thread) was installed and impressed a number of interlacing knots of 12 knots/m on the thread with an air pressure of 4 bar. The inlet tension in the inlet of the interlacing nozzle was adjusted to be 0.15 g/den.

Six threads, each from the same spinning position, were spooled in a spooler to form spool packages, the spooling speed of 4985 m/min chosen such that the thread tension before spooling was 0.1 g/den. Preoriented (POY) threads, characterized by a titer of 126 den, an elongation at break of 116%, and a tear strength of 2.4 g/den were obtained. The POY spools were stretch-texturized with a Barmag texturizing machine, type FK6, with a speed of 900 m/min. The draft ratio was chosen to be 1.77, and the heater temperatures 1 and 2 were chosen to be 210° C. and 170° C., respectively. The texturized yarn had a titer of 74 den, a tear strength of 4.5 g/den and an elongation at break of 18.3%, and was characterized by a good uniformity of dyeing.

We claim:

1. A process of producing synthetic threads from a polyester-based polymer mixture, wherein a) a first stream of a polyester melt is divided into a second and a third polyester stream, the flow rate of the first stream being 100 to 2000 kg/h and the flow rate of the second polyester stream being 5 to 300 kg/h, b) 0.2 to 100 kg/h of a molten additive polymer are metered to the second polyester stream, and the additive polymer together with the second polyester stream is passed through a first mixing line comprising a line with flow obstacles to form a first polymer mixture whose content of additive polymer is 3 to 50 wt-%, wherein the ratio of the melt viscosity of the additive polymer and of the polyester of the first stream is 0.8:1 to 10:1, c) the first polymer mixture is passed through a line portion and introduced into the third polyester stream, and the first mixture together with the third polyester stream is passed through a second mixing line having flow obstacles, thereby forming a second polymer mixture, and d) the second polymer mixture is extruded to obtain filaments, which are cooled and combined to threads, and the threads unwound with speeds of at least 1000 nl/min.

2. The process as claimed in claim 1, wherein before addition to the second polyester stream, the additive polymer is melted in an extruder having an outlet temperature that is 5 to 70° C. lower than the first polyester stream temperature.

3. The process as claimed in claim 1, wherein the additive polymer is amorphous and insoluble in the polyester melt.

4. The process as claimed in claim 1, wherein the additive polymer is kept molten for a dwell time of 0.1 to 5 minutes before contacting the second polyester stream.

5. The process as claimed in claim 4, wherein the additive polymer is kept molten for a dwell time of 0.2 to 7 minutes before contacting the third polyester stream.

6. The process as claimed in claim 1, wherein the first polymer mixture is in contact with the third polyester stream for a flow length L=2D, where D is the inside diameter of first mixing line.

7. The process as claimed in claim 1, wherein the ratio of the melt viscosities of the additive polymer and of the polyester of the first stream is 1.5:1 to 8:1.

* * * * *